US009523369B2

(12) United States Patent
Wang

(10) Patent No.: US 9,523,369 B2
(45) Date of Patent: Dec. 20, 2016

(54) CUSHION PAD FOR CEILING FAN BLADE

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 440 days.

(21) Appl. No.: 14/180,999

(22) Filed: Feb. 14, 2014

(65) Prior Publication Data

US 2015/0233385 A1 Aug. 20, 2015

(51) Int. Cl.
*F04D 25/08* (2006.01)
*F04D 29/34* (2006.01)
*F04D 29/66* (2006.01)

(52) U.S. Cl.
CPC ..... *F04D 25/088* (2013.01); *F04D 29/34* (2013.01); *F04D 29/668* (2013.01)

(58) Field of Classification Search
CPC ..... F04D 25/088; F04D 29/34; F04D 29/668
USPC ..... 411/512, 542, 546, 521
See application file for complete search history.

(56) References Cited

U.S. PATENT DOCUMENTS 3,091,795 A * 6/1963 Budwig ..... F16L 5/027 16/2.1
4,286,777 A * 9/1981 Brown ..... B60G 99/004 248/635
4,869,454 A * 9/1989 Byrne ..... F01N 13/1822 16/2.2
5,069,586 A * 12/1991 Casey ..... A44B 13/007 16/2.1
5,110,081 A * 5/1992 Lang, Jr. ..... F16F 3/0873 248/635
5,295,652 A * 3/1994 Byrne ..... B60G 21/0551 16/2.1
5,303,896 A * 4/1994 Sterka ..... F02B 75/34 244/54
5,304,037 A * 4/1994 Scofield ..... F04D 29/34 416/134 R
5,464,323 A * 11/1995 Scofield ..... F04D 29/34 29/889
5,842,677 A * 12/1998 Sweeney ..... F16F 1/3863 248/56
5,950,277 A * 9/1999 Tallmadge ..... F16B 5/0258 16/2.1
6,557,815 B1 * 5/2003 Klein, II ..... B05B 7/2405 239/346

(Continued)

FOREIGN PATENT DOCUMENTS

GB 2060812 A * 5/1981 ..... F16F 1/38

*Primary Examiner* — Jason L Vaughan
(74) *Attorney, Agent, or Firm* — Ming Chow; Sinorica, LLC

(57) ABSTRACT

A cushion pad for a ceiling fan blade includes an upper pad body and a lower pad body. The upper pad body and the lower pad body each have a neck portion. The neck portion has a through hole. One end of the neck portion has an annular flange. The neck portions of the upper pad body and the lower pad body are respectively inserted in the upper and lower ends of a lock hole of a ceiling fan blade. The upper pad body and the lower pad body are stopped at the mouth of the lock hole through the flanges to provide a stop effect. The cushion pad of the present invention can be assembled easily and applied to various ceiling blades in different thicknesses to enhance its economic benefits.

1 Claim, 4 Drawing Sheets

(56) References Cited

U.S. PATENT DOCUMENTS

| | | | | |
|---|---|---|---|---|
| 8,016,067 | B2 * | 9/2011 | Horgas | F16F 15/08<br>180/232 |
| 2011/0116946 | A1 | 5/2011 | Webb et al. | |

* cited by examiner

CUSHION PAD FOR CEILING FAN BLADE

BACKGROUND OF THE INVENTION

1. Field of the Invention

The present invention relates to a ceiling fan structure, and more particularly to a cushion pad for a ceiling fan blade.

2. Description of the Prior Art

As shown in FIG. 1, U.S. early publication No. 2011/0116946 discloses a fan blade mounting system. The fan blade mounting system comprises a plurality of main bodies 1. Each main body 1 has an axial through hole 2. The main body 1 has a pair of flanges 3 at two ends thereof. The flanges 3 are disposed around the outer periphery of the main body 1. The flanges 3 each have a chamfer 4 at one side thereof, namely, the chamfers 4 of the flanges 3 are disposed at the two ends of the main body 1, respectively. The main body 1 can be smoothly squeezed into a lock hole 6 of a ceiling fan blade 5 through the chamfers 4. To cooperate with the thickness of the ceiling fan blade 5, the main body 1 is confined in the lock hole 6 by the flanges 3. After that, a fastening member of a blade frame is inserted into the through hole 2 of the main body 1 to fix the ceiling fan blade on the blade frame. The main body 1 is to absorb the vibration caused by the operation of the ceiling fan blade and the blade frame, providing a cushion and buffer effect to the joint of the ceiling fan blade and the blade frame so as to prevent noises and vibrations when the ceiling fan operates.

However, the flanges 3 provide a limit effect to the main body 1, so the diameter of each flange 5 is greater than the inner diameter of the lock hole 6 of the ceiling fan blade 5. Though the end of each flange 3 has the chamfer 4, the main body 1 cannot be squeezed into the lock hole 6 of the ceiling fan blade 5 with ease. This results in consumption of time and labor to assemble the ceiling fan. The flanges 3 of the main body 1 provide a limit effect, so the distance between the flanges 3 must cooperate with the thickness of the ceiling fan blade 5. Therefore, the producer has to manufacture various ceiling fan cushion pads in different sizes for different thicknesses of ceiling fan blades. When the ceiling fan is assembled, it is required to mate the cushion pad of the ceiling fan blade with the thickness of the ceiling fan blade. This causes great inconvenience to assemble the cushion pad of the ceiling fan blade. Accordingly, the inventor of the present invention has devoted himself based on his many years of practical experiences to solve these problems.

SUMMARY OF THE INVENTION

The primary object of the present invention is to provide a cushion pad for a ceiling fan blade. The cushion pad can be assembled easily and applied to various ceiling blades in different thicknesses to enhance its economic benefits.

In order to achieve the aforesaid object, the cushion pad of the present invention comprises an upper pad body and a lower pad body. The upper pad body has a first neck portion extending in an axial direction thereof. The first neck portion of the upper pad body has a first through hole which extends axially along the first neck portion to pass through the upper pad body. The upper pad body has an annular first flange at an axial upper end of the first neck portion. The first flange is disposed along an outer periphery of the first neck portion. The lower pad body has a second neck portion extending in an axial direction thereof corresponding to the first neck portion of the upper pad body. The second neck portion of the lower pad body has a second through hole which extends axially along the second neck portion to pass through the lower pad body. The lower pad body has an annular second flange at an axial lower end of the second neck portion. The second flange is disposed along an outer periphery of the second neck portion.

When the cushion pad of the present invention is used, the first neck portion of the upper pad body and the second neck portion of the lower pad body are respectively inserted in the upper and lower ends of a lock hole of a ceiling fan blade. The upper pad body and the lower pad body are stopped at the mouth of the lock hole through the first flange and the second flange to provide a stop effect. The upper pad body and the lower pad body can be mounted at the upper and lower ends of the lock hole easily. The cushion pad can be assembled easily and applied to various ceiling blades in different thicknesses to enhance its economic benefits.

DETAILED DESCRIPTION OF THE PREFERRED EMBODIMENTS

Embodiments of the present invention will now be described, by way of example only, with reference to the accompanying drawings.

Figure 1:
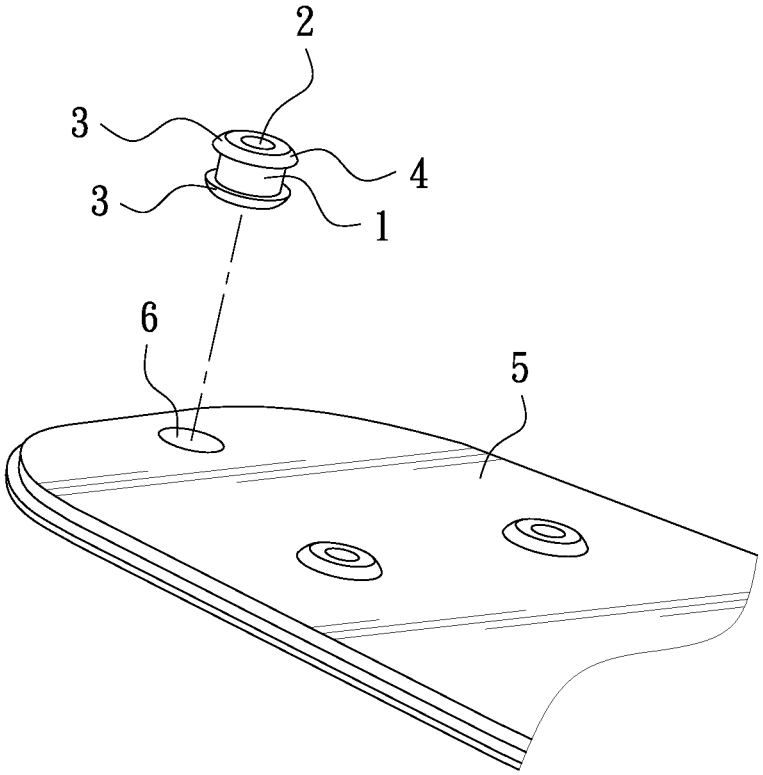
FIG. 1 PRIOR ART
FIG. 1 is a schematic view of a conventional cushion pad for a ceiling fan blade.
Figure 2:
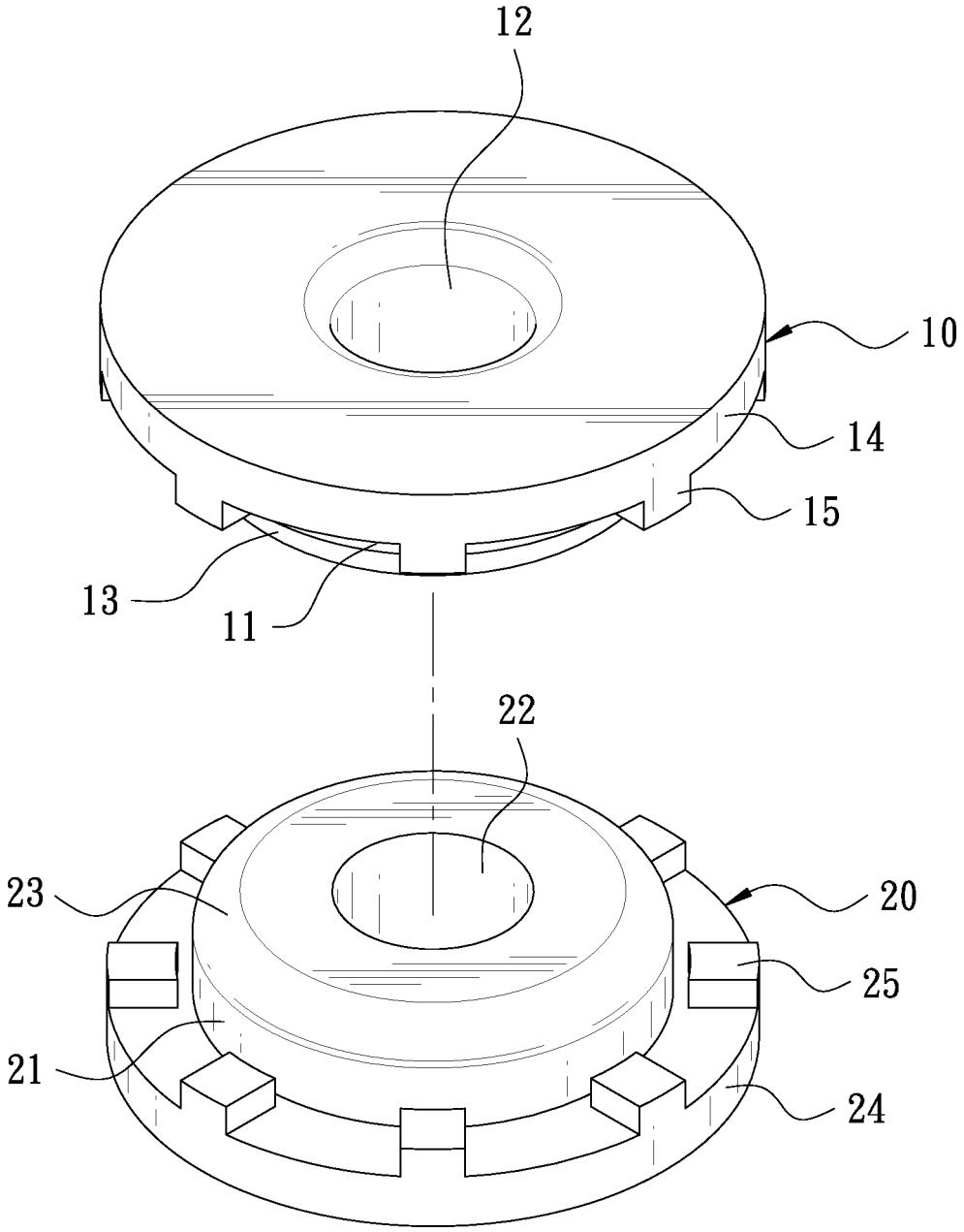
FIG. 2 is an exploded view according to a preferred embodiment of the present invention.

As shown in FIG. 2, a cushion pad for a ceiling fan blade according to a preferred embodiment of the present invention comprises an upper pad body 10 and a lower pad body 20.

The upper pad body 10 is made of a resilient material. The upper pad body 10 has a first neck portion 11 extending in an axial direction thereof. The first neck portion 11 has a cylindrical shape. The first neck portion 11 of the upper pad body 10 has a first through hole 12 which extends axially along the first neck portion 11 to pass through the upper pad body 10. The upper pad body 10 has an annular first chamfer 13 at an axial lower end of the first neck portion 11. The first chamfer 13 is disposed along an outer periphery of the first neck portion 11. The upper pad body 10 has an annular first flange 14 at an axial upper end of the first neck portion 11. The first flange 14 is disposed along the outer periphery of the first neck portion 11. The top surface of the first flange 14 is the surface that the first flange 14 faces the first neck portion 11 in the axial direction of the upper pad body 10. The top surface of the first flange 14 is provided with a plurality of spaced first protrusions 15. The first protrusions 15 are arranged radially along the upper pad body 10. The first protrusions 15 are made of a resilient material. A deformation space is formed between the first protrusions 15 for the first protrusions 15 to be deformed when compressed.

The lower pad body 20 is made of a resilient material. The lower pad body 20 has a second neck portion 21 extending in an axial direction thereof. The second neck portion 21 has a cylindrical shape. The second neck portion 21 of the lower pad body 20 has a second through hole 22 which extends axially along the second neck portion 21 to pass through the lower pad body 20. The lower pad body 20 has an annular second chamfer 23 at an axial upper end of the second neck portion 21. The second chamfer 23 is disposed along an outer periphery of the second neck portion 21. The lower pad body 20 has an annular second flange 24 at an axial lower end of the second neck portion 21. The second flange 24 is disposed along the outer periphery of the second neck portion 21. The top surface of the second flange 24 is the surface that the second flange 24 faces the second neck portion 21 in the axial direction of the lower pad body 20. The top surface of the second flange 24 is provided with a plurality of spaced second protrusions 25. The second protrusions 25 are arranged radially along the lower pad body 20. The second protrusions 25 are made of a resilient material. A deformation space is formed between the second protrusions 25 for the second protrusions 25 to be deformed when compressed.

In order to understand the structural features, the technical means and the expected effects of the present invention, the use of the present invention is described hereinafter.

Figure 3:
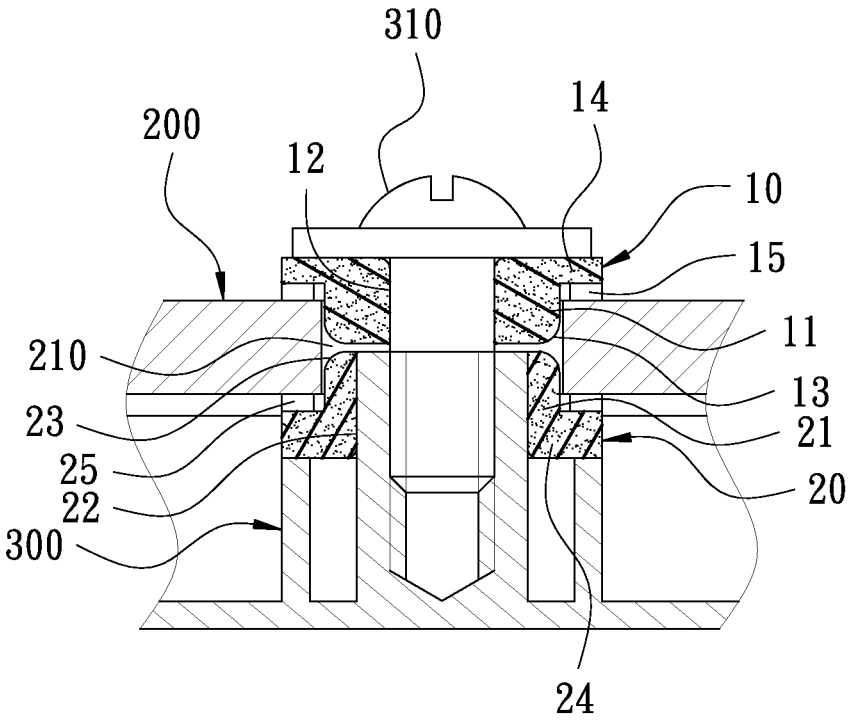
FIG. 3 is a sectional view of the present invention used to a plywood blade.

FIG. 3 is a schematic view of the present invention when in use. When the cushion pad of the present invention is assembled, the ends of the upper pad body 10 and the lower pad body 20, having the first chamfer 13 and the second chamfer 23, are respectively inserted in the same lock hole 210 of a ceiling fan blade 200 to be placed at the upper and lower ends of the lock hole 210. The other upper pad bodies 10 and the other lower pad bodies 20 are inserted in each lock hole 210, respectively. Because the upper pad body 10 and the lower pad body 20 respectively have the first chamfer 13 and the second chamfer 23 as well as the diameter of the first neck portion 11 of the upper pad body 10 and the diameter of the second neck portion 21 of the lower pad body 20 mate with the lock hole 210, the first neck portion 11 of the upper pad body 10 and the second neck portion 21 of the lower pad body 20 can be squeezed into the lock hole 210 easily. The first flange 14 and the second flange 24 of the upper pad body 10 and the lower pad body 20 provide a stop effect, so that the upper pad body 10 and the lower pad body 20 are stopped at the mouth of the lock hole 210. A fastening member 310 on a blade frame 300 is inserted into the second through hole 22 of the lower pad body 20 to fix the ceiling fan blade 200 on the blade frame 300. By using the fastening member 310, the upper pad body 10 and the lower pad body 20 are also fixed to the lock hole 210 steady. The upper pad body 10 and the lower pad body 20 are to absorb the vibration caused by the operation of the ceiling fan blade 200 and the blade frame 300, providing a cushion and buffer effect for the joint of the ceiling fan blade 200 and the blade frame 300 to prevent noises and vibrations when the ceiling fan operates. It is noted that there is no need to squeeze the first flange 14 and the second flange 24, having the diameter greater than that of the lock hole 210, into the lock hole 210, and the diameter of the first neck portion 11 of the upper pad body 10 and the diameter of the second neck portion 21 of the lower pad body 20 mate with the lock hole 210, such that the first neck portion 11 of the upper pad body 10 and the second neck portion 21 of the lower pad body 20 can be squeezed into the lock hole 210 easily. Both the upper pad body 10 and the lower pad body 20 are made of a resilient material. Even if the diameter of the first neck portion 11 of the upper pad body 10 and the diameter of the second neck portion 21 of the lower pad body 20 are slightly greater than the diameter of the lock hole 210, the first neck portion 11 of the upper pad body 10 and the second neck portion 21 of the lower pad body 20 can be compressed through their elasticity and squeezed into the lock hole 210 easily.

It is noted that the first flange 14 of the upper pad body 10 and the second flange 24 of the lower pad body 20 are respectively provided with the first protrusions 15 and the second protrusions 25 to be contact with the ceiling fan blade 200, and the deformation spaces are formed between the first protrusions 15 and the second protrusions 25. When the upper pad body 10 and the lower pad body 20 are fastened and locked, they can be slightly deformed accordingly for the ceiling fan blade 200 and the blade frame 300 to be fixed steady.

In addition, the upper pad body 10 and the lower pad body 20 are made of a resilient material, so they can cooperate with the thickness of the fastening member 310 of the blade frame 300. The first through hole 12 and the second through hole 22 can be elastically expanded or contracted for the fastening members 310 in different sizes to be squeezed into the first through hole 12 and the second through hole 22. The cushion pad of the present invention may have the first through hole 12 and the second through hole 22 in different diameters as well as the first neck portion 11 and the second neck portion 21 in different diameters to cooperate with the ceiling fan blade 200 and the blade frame 300.

Figure 4:
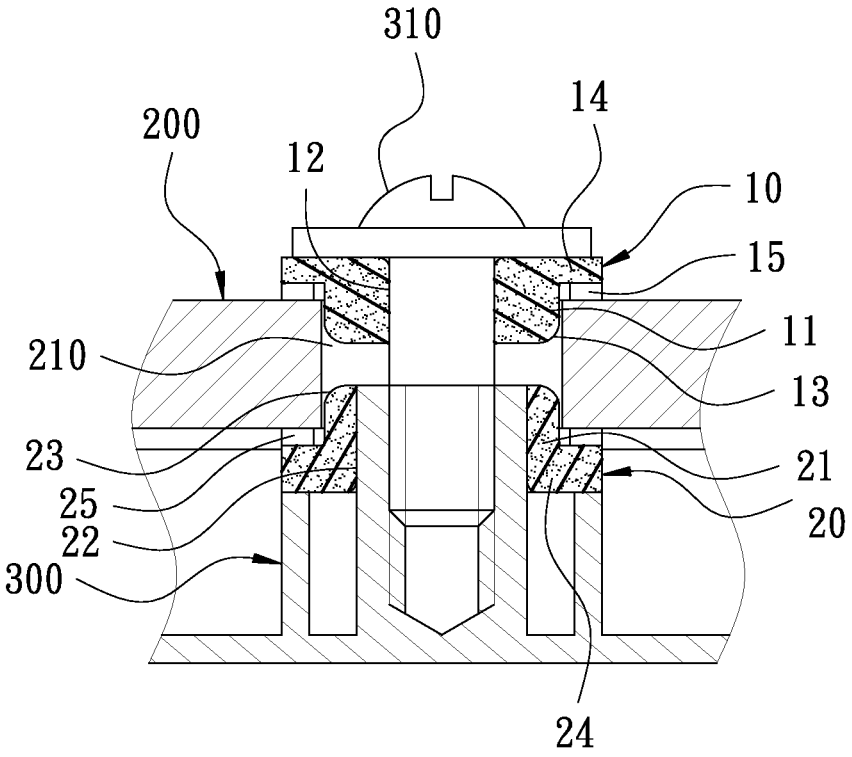
FIG. 4 is a sectional view of the present invention used to a plastic blade.

Referring to FIG. 4 and FIG. 3, the upper pad body 10 and the lower pad body 20 are respectively placed at the upper and lower sides of the ceiling fan blade 200 to provide a cushion effect, so the present invention won't be limited to the thickness of the ceiling fan blade 200. When the ceiling fan blade 200 is thicker, the upper pad body 10 and the lower pad body 20 have a larger distance to provide the cushion effect. When the ceiling fan blade 200 is thinner, the upper pad body 10 and the lower pad body 20 have a smaller distance to provide the cushion effect. Whatever the material and the thickness of the ceiling fan blade may be, the upper pad body 10 and the lower pad body 20 can be respectively placed at the upper and lower sides of the lock hole 210 of the ceiling fan blade 200 to provide a cushion effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cushion pad for a ceiling fan blade, the cushion pad being mounted to a lock hole of the ceiling fan blade, comprising:

an upper pad body having a first neck portion extending in an axial direction thereof, the first neck portion of the upper pad body having a first through hole which extends axially along the first neck portion to pass through the upper pad body, the upper pad body having an annular first flange at an axial upper end of the first neck portion, the first flange being disposed along an outer periphery of the first neck portion;

a lower pad body having a second neck portion extending in an axial direction thereof corresponding to the first neck portion of the upper pad boy, the second neck portion of the lower pad body having a second through hole which extends axially along the second neck portion to pass through the lower pad body, the lower pad body having an annular second flange at an axial lower end of the second neck portion, the second flange being disposed along an outer periphery of the second neck portion;

one surface of the first flange, facing the first neck portion, being provided with a plurality of spaced first protrusions, a deformation space being formed between the first protrusions;

one surface of the second flange, facing the second neck portion, being provided with a plurality of spaced second protrusions, a deformation space being formed between the second protrusions;

the first protrusions being arranged radially along the upper pad body;

the second protrusions being arranged radially along the lower pad body;

the upper pad body having an annular first chamfer at an axial lower end of the first neck portion; and the lower pad body having an annular second chamfer at an axial upper end of the second neck portion.

* * * * *